US006945286B2

(12) United States Patent
Freeman

(10) Patent No.: US 6,945,286 B2
(45) Date of Patent: Sep. 20, 2005

(54) CLOSED LOOP FLUID TRANSFER SYSTEM FOR LIQUID SUPPLY AND VAPOR RECOVERY

(75) Inventor: William H. Freeman, St. Louis, MO (US)

(73) Assignee: Economy Controls Corporation, St. Louis, MO (US)

( * ) Notice: Subject to any disclaimer, the term of this patent is extended or adjusted under 35 U.S.C. 154(b) by 0 days.

(21) Appl. No.: 10/610,616

(22) Filed: Jun. 30, 2003

(65) Prior Publication Data

US 2004/0079439 A1 Apr. 29, 2004

Related U.S. Application Data

(60) Provisional application No. 60/393,290, filed on Jul. 2, 2002.

(51) Int. Cl.[7] ..... B65B 31/00

(52) U.S. Cl. ..... 141/59; 141/285; 141/290; 141/387; 141/388; 141/389

(58) Field of Search ..... 141/18, 59, 65, 141/67, 83, 94–96, 192, 198, 285, 290, 387–389

(56) References Cited

U.S. PATENT DOCUMENTS

| | | | |
|---|---|---|---|
| 138,421 | A | 3/1873 | Matthews |
| 424,259 | A | 3/1890 | Beman |
| 708,942 | A | 9/1902 | Torchiani |

(Continued)

FOREIGN PATENT DOCUMENTS

| | | | |
|---|---|---|---|
| GB | 303275 | | 1/1929 |
| GB | 1102474 | | 2/1968 |
| GB | 1104422 | | 2/1968 |
| GB | 1424001 | | 2/1976 |
| GB | 1530968 | | 9/1977 |
| GB | 2062789 | A | 5/1981 |
| GB | 2062790 | A | 5/1981 |
| GB | 2090949 | A | 7/1982 |
| GB | 2099790 | A | 12/1982 |
| GB | 2146740 | A | 4/1985 |
| GB | 2184103 | A | 6/1987 |
| GB | 2215319 | A | 9/1989 |

*Primary Examiner*—Timothy L. Maust
(74) *Attorney, Agent, or Firm*—Schultz & Little, LLP; Robert Schultz

(57) ABSTRACT

A single-point connection apparatus for a closed fluid transfer delivery system having a mobile dispense to transfers liquid from a chemical delivery vessel to a chemical-receiving device, e.g., a dry cleaning machine, with return flow of vapor therefrom to the delivery vessel. A first passage selectively connects the delivery vessel to the liquid-receiving device. Liquid is only then pumped to the liquid-receiving device. A second passage connects the receiving device to the delivery vessel for a vapor return flow. A chamber of the apparatus has a filling valve to receive a filling adapter to deliver liquid. Associated with the filling valve is a relief valve mechanism providing continuous, uninterrupted liquid flow at an increased liquid flow rate through the first passage, inhibiting backflow of liquid through the second passage for continuous, uninterrupted vapor flow from the liquid-receiving device while liquid is being received by that device.

3 Claims, 1 Drawing Sheet

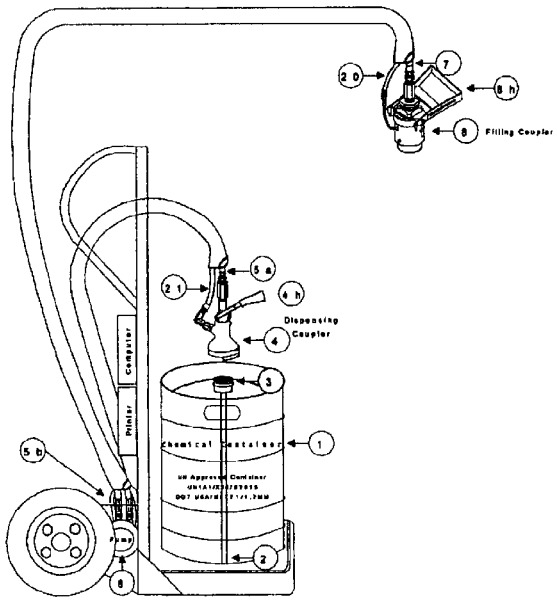

U.S. PATENT DOCUMENTS

| | | | | | |
|---|---|---|---|---|---|
| 731,071 | A | | 6/1903 | Brady | |
| 928,813 | A | | 7/1909 | Spikes | |
| 1,269,639 | A | | 6/1918 | Parr | |
| 1,655,312 | A | | 1/1928 | Daniel | |
| 2,012,362 | A | | 8/1935 | Phillips | |
| 2,056,828 | A | | 10/1936 | Clawson | |
| 2,160,501 | A | | 5/1939 | Hedges et al. | |
| 2,160,683 | A | | 5/1939 | Spaeth | |
| 2,405,998 | A | * | 8/1946 | Buttner et al. | 62/50.2 |
| 2,439,887 | A | | 4/1948 | Elliot | |
| 2,802,492 | A | | 8/1957 | Gasselin | |
| 2,803,269 | A | | 8/1957 | Switzer | |
| 2,882,935 | A | * | 4/1959 | Scharringhausen | 141/43 |
| 2,928,436 | A | | 3/1960 | Wendrow et al. | |
| 3,127,073 | A | | 3/1964 | Carleton | |
| 3,770,028 | A | | 11/1973 | Madden | |
| 3,776,283 | A | | 12/1973 | Kramer | |
| 3,861,569 | A | | 1/1975 | Johnston | |
| 3,908,718 | A | | 9/1975 | Bower | |
| 3,926,231 | A | | 12/1975 | Madden et al. | |
| 3,993,221 | A | | 11/1976 | Boynton et al. | |
| 4,074,734 | A | | 2/1978 | Del Beau et al. | |
| 4,094,346 | A | | 6/1978 | Milo | |
| 4,142,545 | A | | 3/1979 | Billigmeier | |
| 4,181,143 | A | | 1/1980 | Fallon | |
| 4,186,759 | A | | 2/1980 | Stevenson et al. | |
| 4,219,040 | A | | 8/1980 | Fallon et al. | |
| 4,343,325 | A | | 8/1982 | Fallon | |
| 4,344,469 | A | | 8/1982 | Brown | |
| 4,488,572 | A | | 12/1984 | Brown | |
| 4,509,663 | A | | 4/1985 | Fallon | |
| 4,520,954 | A | | 6/1985 | Brown | |
| 4,603,838 | A | | 8/1986 | Gotch | |
| 4,612,952 | A | | 9/1986 | Fallon | |
| 4,632,151 | A | | 12/1986 | Glover | |
| 4,711,377 | A | | 12/1987 | Brown | |
| 4,736,926 | A | | 4/1988 | Fallon | |
| 4,802,513 | A | | 2/1989 | Reynolds | |
| 5,356,045 | A | | 10/1994 | Parks et al. | |
| 5,586,589 | A | | 12/1996 | Voelker | |
| 5,655,577 | A | * | 8/1997 | Loen et al. | 141/59 |
| 5,765,602 | A | * | 6/1998 | Sutton et al. | 141/59 |
| 6,158,486 | A | | 12/2000 | Olson et al. | |
| 6,367,667 | B1 | | 4/2002 | Ipsen | |

* cited by examiner

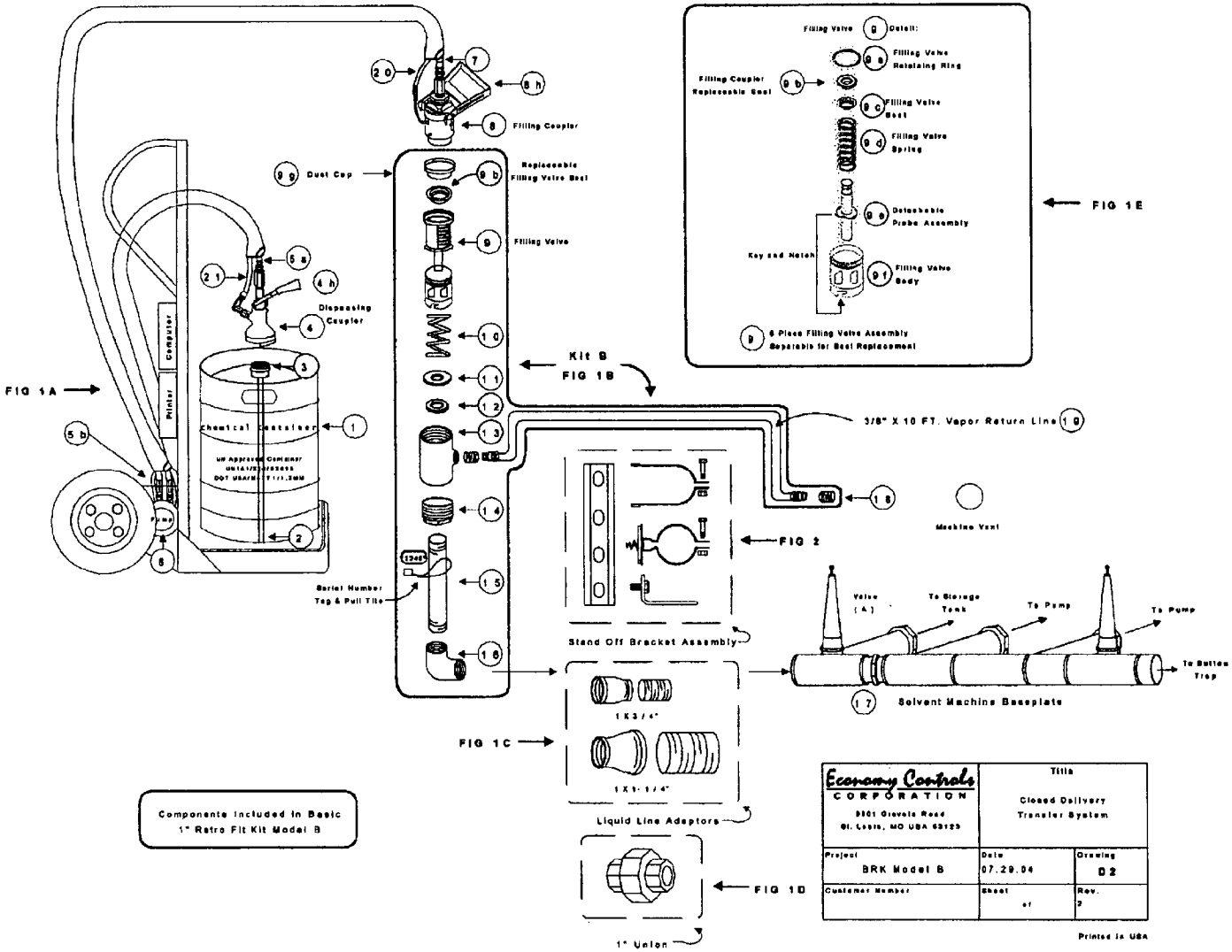
FIG 1E
Detail:
Filling Valve
Retaining Ring
Filling Valve Seat
Filling Valve Spring
Detachable Probe Assembly
Filling Valve Body
Filling Coupler Replaceable Seal
Key and Notch
8 Piece Filling Valve Assembly Available for Seal Replacement
3/8" X 10 FT. Vapor Return Line
Machine Vent
FIG 2
Kit B
FIG 1B
Replaceable Filling Valve Seal
Filling Coupler
Filling Valve
Dust Cap
Dispensing Coupler
Chemical Dispenser
Serial Number Tag & Pull Tite
Computer
Printer
Pump
FIG 1A
Valve (A)
To Storage Tank
To Pump
To Pump
To Bottom Trap
Solvent Machine Baseplate
Stand Off Bracket Assembly
1X3/4"
1X1-1/4"
Liquid Line Adaptors
FIG 1C
FIG 1D
1" Union
Economy Controls CORPORATION
8501 Gravois Road
St. Louis, MO USA 63123
Project
BRK Model B
Customer Number
Date
07.29.04
Sheet
of
Title
Closed Delivery Transfer System
Drawing
D2
Rev.
2
Printed in USA
Components Included In Basic 1" Retro Fit Kit Model B

CLOSED LOOP FLUID TRANSFER SYSTEM FOR LIQUID SUPPLY AND VAPOR RECOVERY

CROSS-REFERENCES TO RELATED APPLICATIONS

Pursuant to 35 U.S.C. §119(e), applicant claims filing date priority from the filing date of a provisional patent application with Ser. No. 60/393,290 filed on or about Jul. 2, 2002 by applicant.

BACKGROUND OF THE INVENTION

This invention relates to a closed loop transfer system and, more particularly, relates to such a system having one-piece leak proof couplers used for liquid supply and vapor recovery.

There are various arrangements in the art for providing closed loop fluid transfer. Such systems used in technologies and in situations where fluid is to be transferred from one vessel to another but where, in doing so, vapor phase components of the fluid must not be permitted to escape from the system, as into the atmosphere. Among the fluids often so transferred are solvents and other volatile organics.

A salient example is perchlorethylene ("PERC" or "perc"), also known as tetrachloroethylene, a colorless, nonflanmable liquid. It is the most common cleaning solvent used in the dry cleaning industry.

Because of the possible risks in human exposure to perchlorethylene vapors, environmental restrictions of a regulatory nature require transfer of perchlorethylene to and from dry cleaning machinery, as between such machinery and shipment or delivery vessels, in a manner as will prevent escape of perchlorethylene vapors. Perchlorethylene is also used in the textile industry and in vapor degreasing and metal cleaning operations. It is also a component in other formulations. Perchlorethylene is representative of a class of volatile organic fluids which, when transferred, should not be permitted to escape as fluid or vapor.

Any such volatile organic fluid is herein referred to for convenience as a "VOF" and, in its liquid phase, is referred to as a "VOF liquid" and in its vapor phase as "VOF vapor".

One such system for providing closed loop fluid transfer for transfer of perchlorethylene transfers this chemical from a mobile dispensing apparatus delivery container to a device to receive the chemical, viz., a dry cleaning machine. In such an arrangement the dispensing apparatus provides a VOF liquid delivery line and a VOF return line. VOF liquid (e.g., perchlorethylene) is pumped from the delivery vessel supported by a cart, for dispensing with precise metering through the VOF liquid delivery line to a fluid-receiving device such as a dry cleaning machine. Vapor is returned to the delivery vessel through a VOF vapor return line. Both lines are preferably connected to the fluid-receiving device by a one-piece dry-disconnect coupler capable of providing both liquid flow and vapor recovery, so as ensure that there will be no leaks or fumes or vapors released when the liquid is dispensed to the machine.

It has been found that under certain flow conditions, the VOF liquid when pumped under certain undesired conditions may result in liquid being forced back into the vapor return line. The undesired conditions may result from improper installation or connection by service personnel of the line fittings to the receiving machine, inadvertent inclination of connectors, or from an imbalanced flow. In any event, the inadvertent return of liquid in the vapor return line is not desirable, as fluid will may not be efficiently received by the fluid-receiving device, or delivery of the liquid VOF may be intermittent. This may require greater filling or "charging" time, or the liquid may not be as accurately metered as desired because of errors introduced because of liquid in the vapor return line.

SUMMARY OF THE INVENTION

It is an object of the invention to provide an improved closed loop fluid transfer systems and, more particularly, to a VOF liquid dispensing apparatus and system having one-piece leak proof couplers used for liquid supply and vapor recovery.

It is a specific object of the invention to provide in the presently inventive arrangement a one-piece dry-disconnect couple capable of providing both liquid flow and vapor recovery, without leakage, but capable of preventing liquid from being forced back into the vapor return line, so that liquid will instead flow fully and completely and with efficiency into the fluid-receiving device, and so that the VOF liquid will be dispensed with precisely accurate metering.

It is a further object of the invention to provide for its use with a portable dispensing system a liquid- and vapor-handling connection arrangement which allows precise delivery of liquid from a fluid reservoir to a fluid-receiving device such as a dry cleaning machine with dripless, leak-free, vapor-tight "dry" connection, ensuring against leaks or fumes when dispensing VOFs or other chemicals; it being also an object of the invention to provide such a connection arrangement which ensures that fluid dispensed from the fluid reservoir will be delivered steadily and continuously, and without interruption from backflow of liquid through vapor passages, and under conditions in which the fluid is precisely metered without variation or error resulting from unintended backflow.

Briefly, a connection system is provided for use in a closed fluid transfer delivery system, which may be a mobile dispensing cart-mounted system, for transferring liquid from a chemical delivery vessel to a chemical-receiving device, herein called a liquid-receiving device, with return flow of vapor to the delivery vessel as fluid transfer takes place. In said connection apparatus, when selectively used for fluid transfer, a first passage connects the delivery vessel to the liquid-receiving device, to allow liquid under pressure to be pumped to the liquid-receiving device. A second passage connects the liquid-receiving device to the delivery vessel for return flow of vapor as the liquid-receiving device receives liquid. The first and second passages form a single connection point at the fluid-receiving device, the connection point comprising a chamber having a relief valve configured for providing continuous, uninterrupted liquid flow at an increased liquid flow rate through the first passage with inhibited backflow of liquid through the second passage for continuous, uninterrupted vapor flow from the liquid-receiving device while liquid is being received by the liquid-receiving device.

Other objects and features will be in part apparent and in part pointed out hereinbelow.

BRIEF DESCRIPTION OF THE DRAWINGS

FIGS. 1A and 1B shows a closed transfer delivery system including a retrofit kit having a relief valve assembly, for connection to a dry cleaning machine.

FIG. 1C shows alternative fittings for connection of the retrofit kit.

FIG. 1D shows a union for such connection.

FIG. 1E shows exploded view of components of Filling Valve.

FIG. 2 shows a stand-off bracket assembly for attachment of the retrofit kit to a dry cleaning machine.

Corresponding characters indicate corresponding elements in the views of the drawings.

DESCRIPTION OF A PRACTICAL EMBODIMENT

Referring to the drawings, the inventive features are embodied in a closed transfer delivery system designated generally A which includes a retrofit kit B including a relief valve assembly C. By means of the retrofit kit B, closed transfer delivery system A is to be connected to a dry cleaning machine D, which is not part of the invention. Only selected liquid supply connection and vapor venting components of dry cleaning machine D are illustrated, for convenience and simplification.

Liquid Supply and Vapor Return

Closed transfer delivery system A is designed to transfer fluids without drips, spills, or fumes, utilizing drip proof one connection couplers, having both liquid supply and vapor return in one coupler, by means of a machine fitting connected to a chemical tank contained on solvent machine, i.e., dry cleaning machine D, where the chemical tank may contain perchlorethylene, for example.

Liquid Supply

System A is cart-mounted, as shown, the features of the cart and its pumping and computing arrangement being known, but carrying a chemical container, i.e., a delivery vessel, designated 1, from which internally thereof liquid is pumped from the lower end of vessel 1 through an extractor tube 2 communicating with an extractor valve 3. A dripless dispensing coupler 4 is selectively connected to an extractor valve 3 for drawing off the liquid through a first section 5*a* of a two-passage filling and venting hose under the computer-controlled operation of a pump 6 of the system. A dispensing coupler 4 when connected is locked by operation of a handle 4*h* so that coupler 4 is in liquid-tight and vapor-tight relationship with container extractor valve 3. Locking of valve 3 in operating position simultaneously opens valves (not, shown) in the container extractor valve 3 and so also in the dispensing coupler.

From pump 6 extends a second portion 5*b* of the two-line filling and venting hose. At the distal end of hose 5*b* a filling coupler 8 is connected to filling valve 9, which can by operation of a handle 8*h* be locked together with a filling valve 9 in fluid- and vapor-tight relationship, similarly opening the valve elements in filling coupler 8 and filling valve 9.

Thus, when pump 6 is turned on under computer control liquid is drawn off the bottom of vessel 1 through the container extractor tube 2 and moves through container extractor valve 3, dispensing coupler 4 and then through hose portion 5*a* under pump suction, and is then discharged from pump 6 through hose portion 5*b* which has a discharge line 7, and then through filling coupler 8 into filling valve 9.

Filling valve 9 forms part of retrofit kit B. Therein, liquid passes out the discharge tube of filling valve 9, and then into a tee 13 carrying filling valve 9, into a bushing 14 threaded into tee 13, thence into a nipple 15 threaded into bushing 14, through an elbow 16 connected by one of various liquid line adapters shown FIGS. 1C and 1D into a chemical solvent tank via a machine base plate 17, equipped so that the solvent can be directed into selected base holding tanks, from which it is used in the machine's process, which may be dry cleaning using the solvent perchlorethylene, for example.

To provide means for preventing fluid from backing up in the assembly of elements 9, 13, 14, 15, and 16 due to back pressure, a pressure relief mechanism is built into the filling valve assembly. The pressure relief valve comprises of a valve seat spring 10, a valve seat disk 11, and valve seat 12. Back pressure may rise to a pressure, as determined by the calibration specification of valve seat spring 10. Pressure exceeding the calibration specification of valve seat spring 10 compresses the spring which lifts the valve seat to allow liquid to be relieved for flow into the vapor return line, and yet it will be appreciated that such pressure relief operation normally will not occur. Yet, if an unlikely and unusual overpressure situation occurs, pressure relief is permitted. Indeed, the design of retrofit kit B is such that it is capable of providing both liquid flow and vapor recovery, without leakage, but capable of preventing liquid from being forced back into the vapor return line, so that liquid will instead flow fully and completely and with efficiency into the dry cleaning machine or other fluid-receiving device, and so that the solvent will be dispensed and transferred to the machine with precisely accurate metering.

Vapor Return

During filling of the fluid-receiving device, such as the dry cleaning machine here described, vapor from the machine is recovered into chemical container 1. This provides a means for displacing the fluid leaving the vessel 1 with vapor from the machine. That is, as liquid is pumped out of container 1 by pump 6, vapor from the machine's tank is drawn back into container 1 without release to the atmosphere. Specifically, vapor at the top of the machine's storage tank enters at connection 18, and into the vapor return hose 19, to tee 13. The vapor port into tee 13 enters above valve seat 11, and so vapor can flow into filling valve 9, and then into filling coupler 8. Filling valve 9 and filling coupler 8 are internally in compartmental communication, providing separate paths for fluid and vapor to keep them are separate and isolated.

In this way, vapor enters vapor return line 20, and can then flow back into the dispense coupler 4 via communication 21. The Dispense coupler is also internally compartmental, providing separate paths for fluid and vapor to keep them are separate and isolated, normally allowing only vapor to return to container 1.

Accordingly, vapor is exchanged between the chemical tank of the liquid-receiving device and delivery vessel or container 1. Neither liquid nor vapor are permitted to escape from this closed system. Only "dry" (dripless and vapor-tight) connections are permitted by couplers 4 and 8.

Installation of the system and its use in connection with dry cleaning machines is facilitated by installing retrofit kit B FIG. 2 shows a stand-off bracket assembly for attachment of the retrofit kit to a dry cleaning machine. In such installation, the elements of the valve arrangement C and elements 13, 14, 15 are oriented on a vertical axis as shown, presenting filling valve 9 for ready connection by receiving filling coupler 8. A dust cap 9*d* is preferably used; it protects filling valve 9 from contamination until readiness for receiving coupler 8.

Therefore, it will be seen that a mobile cart pumping arrangement using a transportable vessel 1, which may be of long-lasting stainless steel, capable of decades of use, may be used advantageously for chemical delivery, as for providing perchlorethylene for recharging dry cleaning machines, and may be connected therewith, or other fluid-receiving device, to provide a closed transfer delivery system. Connection with such a device is facilitated by retrofit kit B including a relief valve assembly C.

The advantageous features assure that the dry cleaning machine or other fluid-receiving device is provided with a dripless, leak-free, vapor-tight "dry" liquid delivery connection with vapor transfer back to the delivery vessel, ensuring against leaks or fumes when dispensing VOF's or other chemicals and volatile fluids. The new connection arrangement ensures that fluid dispensed from the delivery reservoir will be delivered steadily and continuously, and without interruption from backflow of liquid through vapor passages, and under conditions in which the fluid is liquid is with precisely metered without variation or error resulting from unintended backflow.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. For use with a liquid delivery system, a connection system for closed fluid transfer delivery, wherein the connection point is provided by a filling assembly having a filling valve for receiving a filling coupler to communication with the liquid dispensing source comprising:

apparatus for selective connection to, and selective disconnection from, a liquid dispensing source having a delivery vessel for a deliverable liquid to receive liquid dispensed from the delivery vessel for transfer to liquid-receiving device, with return flow of vapor to the delivery vessel as fluid transfer takes place; said apparatus providing a first passage providing selective communication between the delivery vessel and the liquid receiving device, to allow liquid under pressure to be pumped to the liquid-receiving device;

a second passage providing communication, simultaneously with the communication provided by the first vessel, between the liquid-receiving device and the delivery vessel for return flow of vapor as the liquid-receiving device receives liquid;

the first and second communication being established by quick connect/disconnect at a single connection point at the liquid-receiving device;

the connection point comprising a chamber having a relief valve mechanism for providing continuous, uninterrupted liquid flow at an increased liquid flow rate through the first passage with inhibited backflow of liquid through the second passage for continuous, uninterrupted vapor flow from the liquid-receiving device;

the filling assembly including a housing for the relief valve;

the relief valve mechanism comprises a valve seat spring, a valve seat disk, and a valve seat;

the relief valve operation being such that if back pressure may rise to a relief pressure, as determined by a calibration specification of valve seat spring, pressure exceeding the calibration specification of valve seat spring 1 compresses the spring which lifts the valve seat to allow liquid to be relieved for flow into the vapor return line;

the relief valve operation being such that such pressure relief operation normally will not occur.

2. Apparatus as set forth in claim 1 wherein the fluid-receiving device is a dry cleaning machine and the liquid is perchloroethylene.

3. For use in a closed fluid transfer system for transferring liquid from a first vessel to a second vessel, by a first passageway connecting the first vessel and the second vessel, a second passageway connecting the first vessel and the second vessel for simultaneously venting a gas displaced from the second vessel by a transfer of liquid from the first vessel to the second vessel, the first and second passageways forming a single connection with the first vessel, the improvement comprising a relief valve being introduced along the single connection for providing increased liquid transfer rates from the first vessel to the second vessel with the reduced backflow of liquid from the second vessel to the first vessel, wherein the relief valve comprises a valve element, a seat, a seal, and means biasing the valve element toward the seat, normally to maintain a separation between the liquid and vapor phases, whereby the liquid may flow from the first vessel to the second vessel, and vapor may flow from the second vessel to the first vessel, but permitting liquid from returning to the first vessel only in the event of overpressure lifting the valve element from the seat.

* * * * *